United States Patent [19]

Chikamori et al.

[11] Patent Number: 4,829,683

[45] Date of Patent: May 16, 1989

[54] ARTICLES OF CLOTHING FOR USE IN CLEAN ROOMS

[76] Inventors: Yoshihiro Chikamori, 317-Kanemoto, Okayamashi 703; Hiromi Nakamura, 460-Yoshinaga-cho; Ayako Ariyoshi, 703 Yoshinaga-cho, both of Wake-gun 709-02; Norie Sugimoto, 356-1 Nagaoka, Okayamashi 703, all of Japan

[21] Appl. No.: 114,765

[22] Filed: Oct. 30, 1987

[30] Foreign Application Priority Data

Oct. 31, 1986 [JP] Japan ..... 61-166669[U]

[51] Int. Cl.[4] ..... A43B 23/04

[52] U.S. Cl. ..... 36/51; 36/50; 2/DIG. 7

[58] Field of Search ..... 36/51, 54, 7.3, 7.1 R, 36/3 R, 50; 2/DIG. 7

[56] References Cited

U.S. PATENT DOCUMENTS

| | | | |
|---|---|---|---|
| 2,508,994 | 5/1950 | Demick | 36/54 |
| 2,666,996 | 1/1954 | Odland | 36/7.3 |
| 3,059,352 | 10/1962 | Clason | 36/50 |
| 4,196,245 | 4/1980 | Kitson et al. | 2/DIG. 7 |
| 4,344,999 | 8/1982 | Gohlke | 2/DIG. 7 |
| 4,507,880 | 4/1985 | Ohashi | 36/3 R |
| 4,512,089 | 4/1985 | Carrier | 36/50 |
| 4,689,902 | 9/1987 | Lears, Jr. | 36/50 |

*Primary Examiner*—Steven N. Meyers
*Attorney, Agent, or Firm*—Martenson Uebler

[57] ABSTRACT

Articles of clothing for use in a clean room environment are provided. A cut-out with an attached fastener such as a zipper is formed in the donning-and-removing opening of the main body of the clothing and a gore made of an anti-dust fabric is attached to the inside of the cut-out.

2 Claims, 2 Drawing Sheets

Fig. 1.
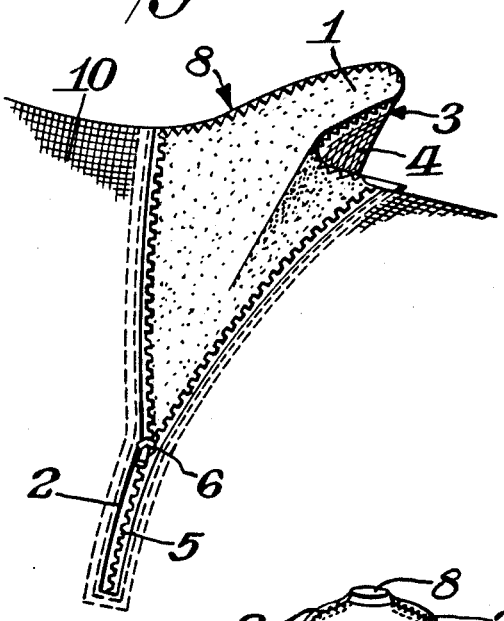
Fig. 2.
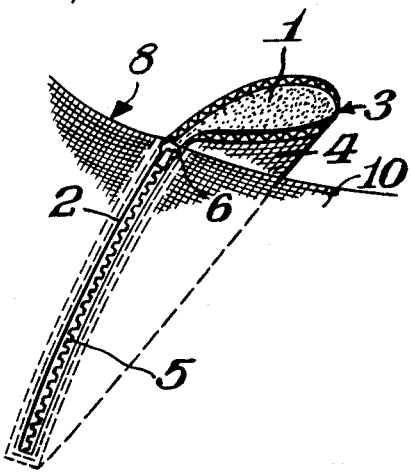
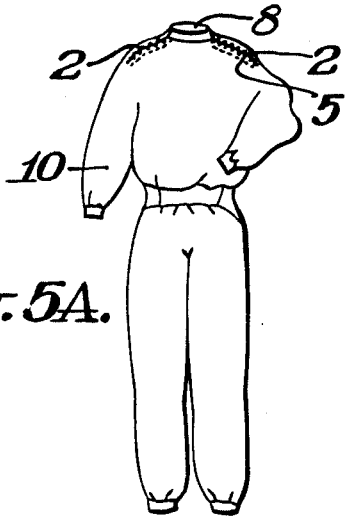
Fig. 5A.
Fig. 5B.
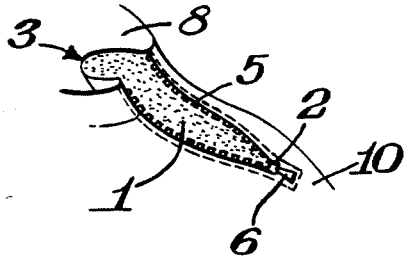
Fig. 6A.
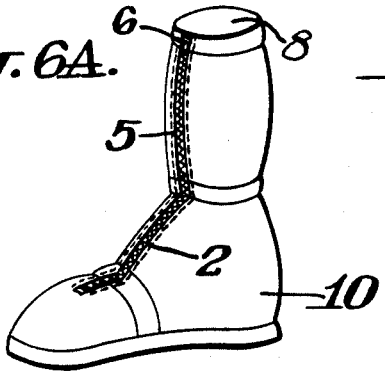
Fig. 6B.
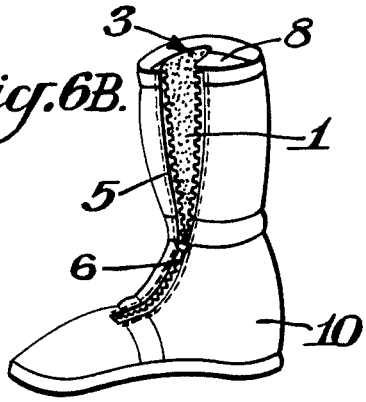

ARTICLES OF CLOTHING FOR USE IN CLEAN ROOMS

BACKGROUND OF THE INVENTION

The present invention concerns an article of clothing for use in clean rooms. The object of the present invention is to provide an article of clothing for use in clean rooms consisting of dustless clothing and shoes, which effectively prevents the generation of dust from the donning-and-removing opening of the clothing as well. Such articles of clothing are used in clean rooms which are required in the manufacture of semiconductors, precision instruments, electronic parts, medical products and foodstuffs.

Clean rooms are used where prevention of the admixture of dust is strongly required in manufacturing processes such as, for example, semiconductors and medical products. Workers working in such clean rooms wear dust-free clothing. This clothing prevents contamination of the clean room by dust from the human body, and consists of dust-free clothing which is formed from a material having a structure that prevents the passage of fine dust particles. In such dust-free clothing, however, a cut-out is formed in the donning-and-removing opening of the clothing which is used in order to don and remove the clothing. A fastener is attached to this cut-out. A large opening is formed when the clothing is in the process of being donned. After the clothing is donned, the cut-out is closed by means of the aforementioned fastener, so that the clothing can be worn in a state which appropriately conforms to the human body.

In the case of the abovementioned conventional dust-free clothing, the generation of dust can be effectively prevented by the structure of the material of clothing. However, dust from the human body can escape out through the gaps in the aforementioned engaged fastener. In other words, as the worker moves around, dust generated from the human body inside the dust-free clothing can escape through the aforementioned gaps making it impossible to maintain the painstakingly achieved degree of cleanliness in the clean room.

SUMMARY OF THE INVENTION

An article of clothing for use in clean rooms is provided. The article has a cut-out portion with attached fastener formed in the donning-and-removing opening of the main body of the article, and a gore made of an anti-dust fabric attached inside of the cut-out. The gore is preferably expanded, porous polytetrafluoroethylene or elastic, expanded, porous polytetrafluoroethylene.

BRIEF DESCRIPTION OF THE DRAWINGS

FIG. 1 is a pictorial view of each gore attachment area, in the open configuration of the fastener, according to the present invention.

FIG. 2 is a pictorial view of the gore attachment area wherein the fastener is closed.

FIG. 5A shows a clean room suit and FIG. 5B shows the shoulder of the clean room suit wherein the fastener of the gore of the invention is in the open configuration.

FIG. 6A shows a foot covering and FIG. 6B shows the gore of the invention affixed to the foot covering wherein the fastener is in the open configuration.

Figure 3:
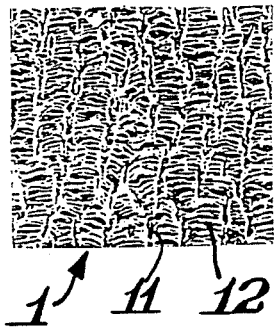
FIGS. 3 and 4 are photomicrographs of the porous, expanded polytetrafluoroethylene used in the gores of the present invention.

DETAILED DESCRIPTION OF THE INVENTION AND PREFERRED EMBODIMENTS WITH REFERENCE TO THE DRAWINGS

Articles of clothing for use in a clean room environment are provided. A cut-out with an attached fastener such as a zipper is formed in the donning-and-removing opening of the main body of the clothing and a gore made of an anti-dust fabric is attached to the inside of the cut-out.

More specifically, the present invention comprises an article of clothing for use in clean rooms which is characterized by the fact that (a) a cut-out with an attached fastener is formed in the donning-and-removing opening of the clothing, which is formed from a material that prevents the generation of dust); and (b) a gore made of an anti-dust fabric is attached on the inside of the cut-out.

Fine dust particles with diameters on the order of 0.1 microns are effectively filtered out by the aforementioned gore which preferably is made of an expanded, porous polytetrafluoroethylene film. Accordingly, the generation of dust from the gaps in the aforementioned fastener is substantially prevented.

A detailed description of the invention and preferred embodiments is best provided with reference to the accompanying drawings.

As is shown in FIGS. 1 and 2, a cut-out 2 with an attached fastener 5 is formed in a portion of the donning-and-removing opening 8 of the main body 10 of the article of clothing. The article of clothing is formed from a material that prevents the generation of dust. A gore 3 consisting of a laminate of an anti-dust fabric, preferably a porous polytetrafluoroethylene film 1 is attached on the inside of the cut-out 2 as shown. When the fastener 5 is opened by means of the opening-and-closing part 6, the triangular gore 3 opens out sufficiently so that a donning-and-removing opening sufficient for donning or removing the suit of clothing is formed. When the fastener is closed as shown in FIG. 2, the gore 3 is accommodated in a folded or similar state inside the donning-and-removing opening 8, so that the suit of clothing can be worn in a stable state in which the suit of clothing conforms to the contours of the human body.

Figure 4:
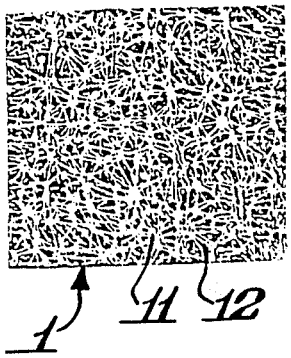

Regarding the material used to form the aforementioned main body 10 of the article of clothing, any material which has a structure that prevents the generation of dust as described above may be used. An example of a desirable material is a material formed by laminating a porous, expanded polytetrafluoroethylene film similar to that used for the aforementioned gore 3 with some other appropriate material. Some examples of the fibrous micro-structure of this porous polytetrafluoroethylene film 1 are shown in FIGS. 3 and 4. As is shown in these figures, a material in which numerous micronodes 11 are connected by countless microfibers 12 in a spider-web-like pattern is formed by rolling and drawing a polytetrafluoroethylene film as disclosed in U.S. Pat. No. 3,953,566. Since the pore diameter of this material is approximately 0.2 microns or smaller, even fine dust particles with diameters on the order of 0.1 micron are captured at the rate of 99.9% of the dust particles or greater. Thus, this material has desirable anti-dust properties. Furthermore, the porous structure of the material allows the passage of water vapor generated by perspiration but acts in conjunction with the water-repelling properties of the resin film to prevent the passage of liquid water. Accordingly, a material formed by laminating this film with another fabric material 4 as indicated in FIGS. 1 and 2 has dust-proof and water-proof properties and also eliminates discomfort caused by perspiration thus allowing comfortable wear.

By forming small folds in such a porous, expanded polytetrafluoroethylene film 1 or laminating the film with an elastic fabric, it is possible to obtain a gore which has elastic properties. The use of such an elastic gore 3 in the manner described above prevents the leakage of dust particles, and at the same time, facilitates donning and removal of the suit of clothing.

Examples of the present invention are illustrated in FIGS. 5 and 6. In the example shown in FIG. 5A, the main body 10 consists of a body suit. Cut-outs 2 with fasteners 5 are formed in the shoulder areas on either side of the donning-and-removing opening 8 in the neck of this body suit. Gore 3, each of a porous, expanded polytetrafluoroethylene film 1 of clothing can be donned or removed by appropriately opening the fasteners 5 as shown in FIG. 5B.

In the example shown in FIG. 6A, the main body 10 is used for shoes. The constitution of the invention in this case is the same as in the example described above in terms of cut-outs, gores and fasteners. The shoes are put on or removed by opening the respective fasteners 5 as shown in FIG. 6B. The present invention may also be similarly applied to gloves and other articles of clothing.

As described above, the present invention makes it possible to obtain articles of clothing for use in clean rooms, such as suits and shoes, which are stable and which can easily be donned or removed using fasteners. Furthermore, the passage of dust through the gaps in the aforementioned fasteners can be substantially prevented. Accordingly, the present invention has great practical merit.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. In an article of clothing for use in clean rooms, said article having a cut-out portion with attached fastener formed in the donning-and-removing opening of the main body of said article, a gore made of an elastic, anti-dust fabric having a filtration efficiency of at least 99% to particles with diameters of about 0.1 microns or greater attached inside of said cut-out.

2. The gore of claim 1 made of expanded, porous polytetrafluoroethylene.

* * * * *